US006788261B1

(12) United States Patent
Buren

(10) Patent No.: US 6,788,261 B1
(45) Date of Patent: Sep. 7, 2004

(54) ANTENNA WITH MULTIPLE RADIATORS

(75) Inventor: Alan Van Buren, Cedar City, UT (US)

(73) Assignee: Wilson Electronics, Inc., Saint George, UT (US)

( * ) Notice: Subject to any disclaimer, the term of this patent is extended or adjusted under 35 U.S.C. 154(b) by 7 days.

(21) Appl. No.: 10/410,114

(22) Filed: Apr. 9, 2003

(51) Int. Cl.[7] ..... H01Q 1/10; H01Q 1/32

(52) U.S. Cl. ..... 343/715; 344/722; 344/900; 344/749

(58) Field of Search ..... 343/715, 722, 343/745, 749, 900

(56) References Cited

U.S. PATENT DOCUMENTS 5,072,230 A * 12/1991 Taniyoshi et al. ..... 343/715
5,079,562 A * 1/1992 Yarsunas et al. ..... 343/792
5,917,452 A * 6/1999 Harada et al. ..... 343/715
6,008,768 A * 12/1999 Wilson et al. ..... 343/749
6,191,747 B1 * 2/2001 Cosenza ..... 343/749
6,215,451 B1 4/2001 Hadzoglou ..... 343/715
6,714,164 B2 * 3/2004 Shimizu ..... 343/715

* cited by examiner

*Primary Examiner*—Tan Ho
(74) *Attorney, Agent, or Firm*—Leon D. Rosen

(57) ABSTRACT

An antenna can efficiently radiate at both the lower cell phone frequency band of about 850 MHz and the higher cell phone frequency band of about 1920 MHz that are in current use. The antenna includes a vertical conductor with an upper portion (32) of a length that is about ½ wavelength at the lower frequency to effectively radiate at that frequency. An upper PRD (phase reversal device) (40) located along the upper conductor portion divides it into top and bottom parts (60, 70) each of about ½ wavelength at the higher frequency, the PRD providing a 180° phase reversal at the higher frequency without affecting the lower frequency. A lower conductor portion (34) includes a coil (80) that produces a phase reversal at the lower frequency, a lower PRD (82), and a short straight conductor part (84). A lower conductor part (90) extends through the lower PRD (82) and connects through a mount member (130) to a coaxial feed.

17 Claims, 3 Drawing Sheets

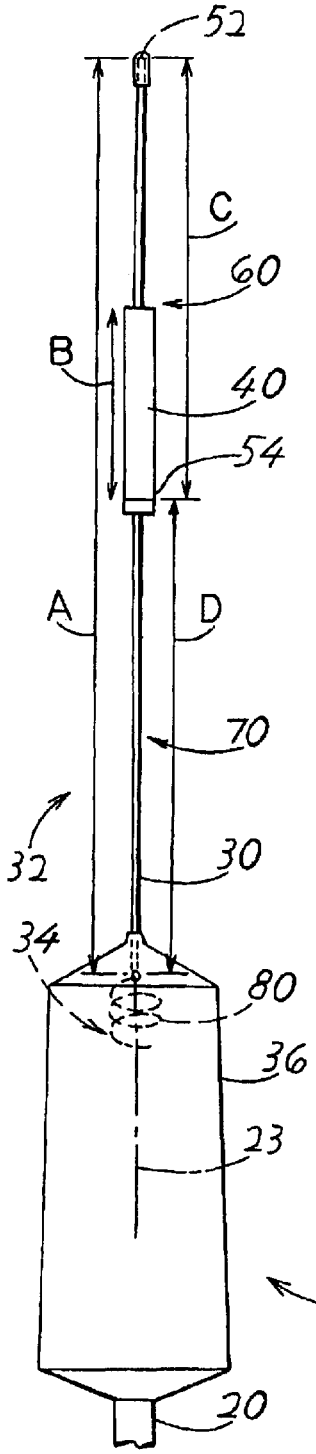
FIG. 3
FIG. 5
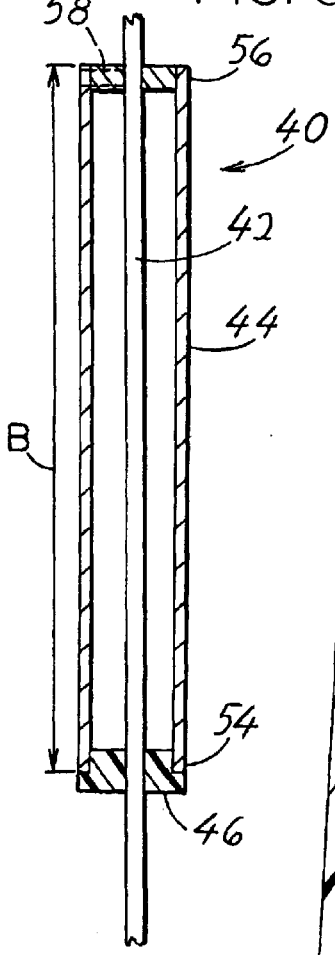
FIG. 4
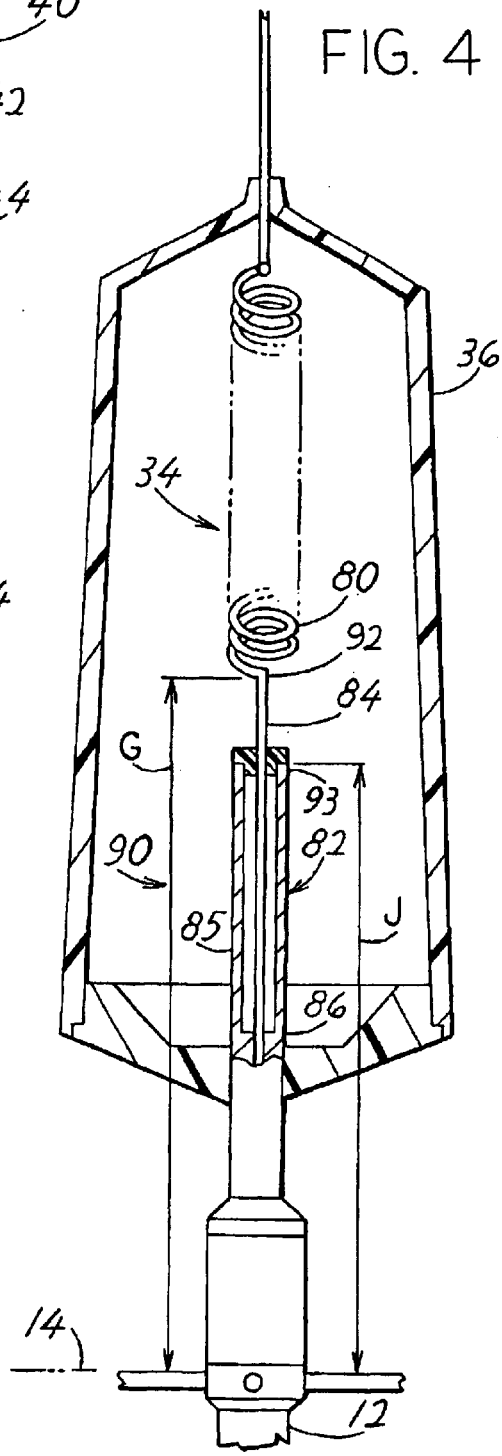

ANTENNA WITH MULTIPLE RADIATORS

BACKGROUND OF THE INVENTION

The two most commonly used frequency bands set aside for cell phone use, are the AMPS band which extends from 806 to 894 MHz and which is sometimes referred to as the "800 megahertz band", and the PCS band which extends from 1850 to 1990 MHz and which is sometimes referred to as the "1900 megahertz band". The center of the lower frequencies is about 850 MHz while the center of the higher frequencies is about 1920 MHz. Cell phones are often used in vehicles, where much of the signal is lost due to the metal vehicle body. The losses can be greatly reduced by mounting an antenna outside the vehicle and coupling a cell phone to that antenna.

Antennas are available that are resonant to either the low frequency band of about 850 MHz (35.3 centimeters) or to the high frequency band of about 1920 MHz (15.6 centimeters). It is possible to mount two antennas, but this adds cost and complexity and cell phone users often do not know what frequency their cell phones operate on. Thus, there is a need for a cell phone antenna that can efficiently radiate at both the lower frequency of about 850 MHz and the higher frequency of about 1920 MHz, so it can be used with any of the latest common cell phones.

SUMMARY OF THE INVENTION

In accordance with one embodiment of the present invention, a cell phone antenna is provided, which can efficiency radiate at both common cell phone frequencies, of about 850 MHz and 1920 MHz. The antenna includes a vertically elongated antenna conductor that is divided into radiators that resonate at selected ones of the frequencies, and that include phase reversal means for producing 180° phase reversals so two radiators spaced along the height of the antenna, that radiate at the same frequency are in phase for efficient combined radiation.

An upper conductor portion has a length that is about ½ wavelength (electrical) at the 850 MHz band to radiate at that frequency. An upper PRD (phase reversal device), with its upper end shorted and its lower end non-shorted, divides the upper conductor portion into lower and upper radiators that radiate at the 1920 MHz band. The upper PRD has a physical length of about ¼ wavelength at the 1920 MHz band, to produce a phase reversal at the upper half of the upper conductor portion, so the upper and lower radiators at the 1920 MHz band radiate effectively. The upper PRD has no effect at 850 MHz, unlike other possible PRDs such as coils.

The lower conductor portion includes a coil that produces a phase reversal at the 850 MHz band. The antenna conductor forms a vertical wire that extends up from the top of a lower PRD to the bottom of the coil. The distance between a ground plane at the bottom of the lower conductor portion and the bottom of the coil is about ¼ wavelength at the 850 MHz band to produce another low frequency radiator at that band. The lower PRD adds a phase reversal at its non-shorted top, at the 1920 MHz band. This allows the PRD to lie along the 850 MHz radiator without affecting the phase or electrical length of the 850 MHz radiator. The distance between the ground plane and the top of lower PRD is electrically ⅜ wavelength at 1920 MHz, to provide a moderately effective impedance match for moderately efficient feeding of currents at 1920 MHz. The distance between the ground plane and the bottom of the coil is electrically ¼ wavelength at 850 MHz, for efficient feeding at 850 MHz.

The novel features of the invention are set forth with particularity in the appended claims. The invention will be best understood from the following description when read in conjunction with the accompanying drawings.

BRIEF DESCRIPTION OF THE DRAWINGS

FIG. 3 is a front elevation view of the antenna.

FIG. 4 is a partially sectional view of the lower conductor portion of the antenna of FIG. 3.

FIG. 5 is an enlarged sectional view of a PRD (phase reversal device) of the antenna of FIG. 3.

DESCRIPTION OF THE PREFERRED EMBODIMENTS

Figure 1:
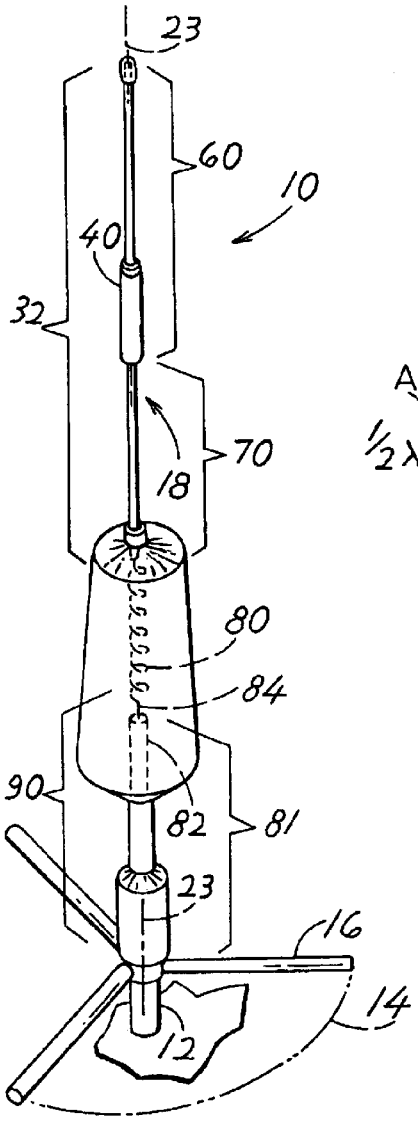
FIG. 1 is a top isometric view of an antenna with multiple radiators of two different frequencies, constructed in accordance with the present invention.

FIG. 1 is an overall view of an antenna 10 of the present invention, which comprises an antenna whip 18, extending above a ground plane 14. The antenna has radiator portions 32, 90 that radiate in a band centered on 850 MHz, and has portions 60, 70, 81 that radiate in a band centered on 1920 MHz. The radiator portions of different frequencies physically overlap, which enables fitting in long radiators at each frequency, and high gain at each frequency, in an antenna of moderate length.

Figure 2:
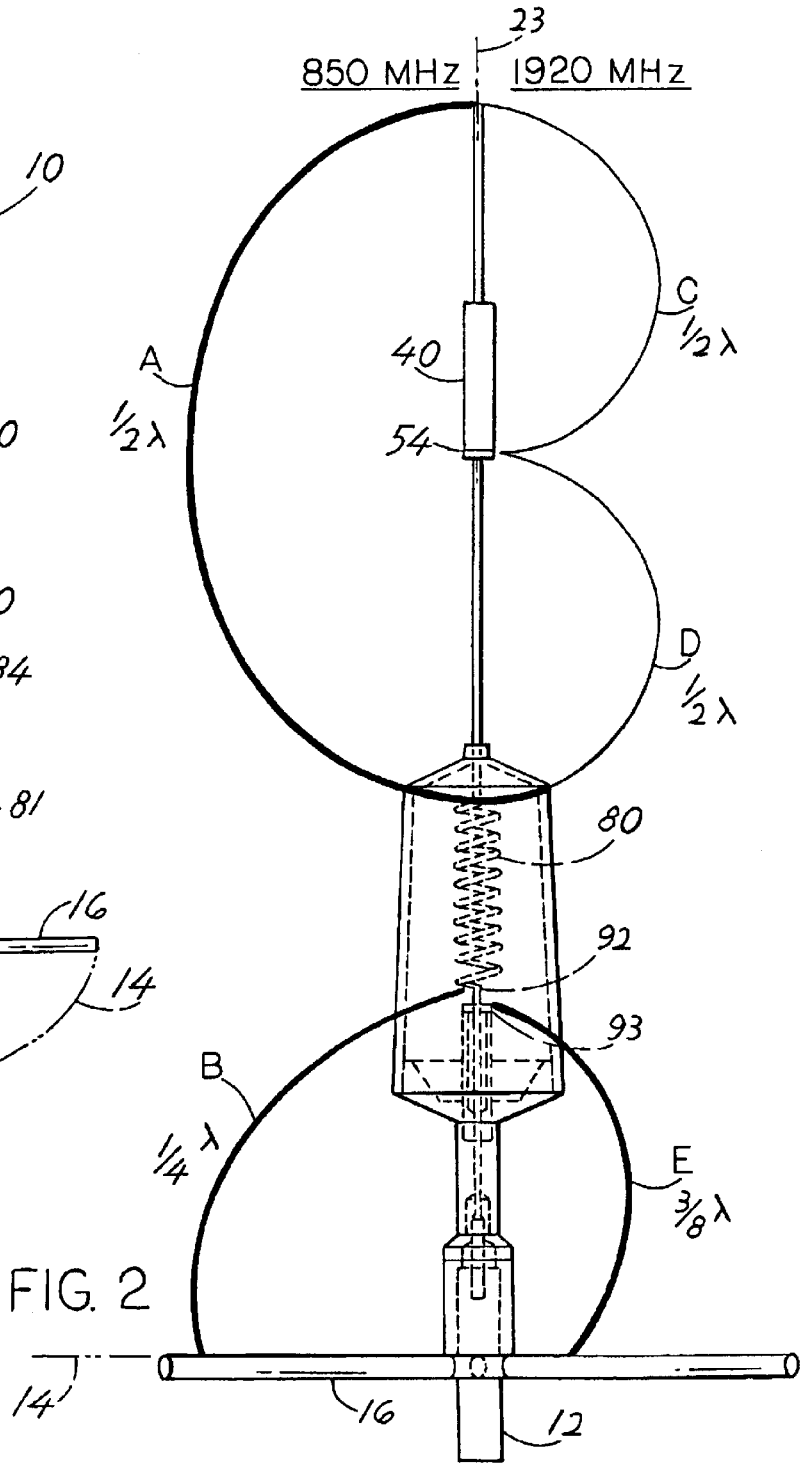
FIG. 2 is a side elevation view of the antenna, with radiating fields indicated for each of two frequencies.

FIG. 2 shows radiation patterns at two different frequencies. Radiation patterns A, B to the left of the antenna axis 23 represent radiation in the 850 MHz band and radiation patterns C, D, E to the right of the axis 23 represent radiation patterns in the 1920 MHz band. There is a phase reversal (180° phase shift) at 1920 MHz at locations 54 and 93. There is a phase reversal at 850 MHz along a coil 80. A fraction followed by "λ" indicates the wavelength; e.g. ½λ at C indicates an electrical length of one-half wavelength (for frequency 1920 MHz).

FIG. 1 shows the antenna 10 in the form of a whip 18 that has a lower end 12 for mounting on a vehicle or other type of antenna mounting structure. The radiating portion of the antenna extends above a ground plane 14. The ground plane can be a metal body of a vehicle, or can be formed by rods 16 or other means. FIG. 1 shows radial rods 16 attached to a metal fitting which is attached to the outer conductor of a coax feed (coax cable or connector) below the radiator, the particular antenna shown having three rods equally spaced about the vertical axis 23 of the whip. The antenna is designed to radiate at a long wavelength cell phone frequency of 850 MHz (806 to 894 MHz) and at a short wavelength cell phone frequency of 1920 MHz (1850 to 1990 MHz). The two wavelengths are not resonant to each other; for example, a quarter wavelength of the long wavelength (35¾=8.8 cm) times an integer (e.g. 8.8×2=17.7 cm) is more than 8% greater or less than the short wavelength (15.6 mm).

As shown in FIG. 3, the antenna whip includes an antenna conductor 30 in the form of an insulated thick wire (2 mm diameter) having upper and lower conductor portions 32, 34. The lower conductor portion 34 lies largely within an insulative mount shell 36, while the upper conductor portion 32 extends above the coil 80. The upper conductor portion has an electrical length A which is approximately ½ wavelength at 850 MHz. The upper conductor portion of length A forms a ½ wavelength radiator for the 850 MHz band.

The upper conductor portion 32 has a PRD (phase reversal device) 40, of the construction illustrated in FIG. 5. The PRD has a center conductor portion 42 and has a conductive sleeve 44 surrounding the center conductor portion 42. The top 56 of the conductive sleeve 44 is electrically connected to the center conductor portion by a set screw 58. The lower end of the sleeve is spaced from the center conductor portion by a dielectric, or nonconductive, washer 46, and forms a phase reversal point. The length B of the PRD 40 is electrically approximately a ¼ wavelength at 1920 MHz. As a result, currents flowing up along the conductor 42 to the shorted upper end of the PRD and then reversing direction to flow down the inside of the PRD 44 to its lower end 54, travel a distance of ½ wavelength and undergo a 180° phase shift, which is often referred to as a phase reversal. The distance C (FIG. 3) between the bottom of the PRD at 54 (which is a phase reversal point) and the top 52 of the antenna whip, is about ½ wavelength (electrical) at the 1920 MHz band. This results in a radiator 60 (of length C) at the 1920 MHz frequency band.

A portion 70 of the conductor between the top of the coil 80 and the bottom of the PRD at 54, has an electrical length D of about ½ wavelength for the 1920 MHz band. The conductor portion 70 of length D is a radiator at the 1920 MHz band.

Thus, the upper conductor portion 32 not only forms a radiator of electrical length A of ½ wavelength at 850 MHz, but forms two radiators at 60 (length C) and 70 (length D), each having an electrical length of ½ wavelength at 1920 MHz, and with the PRD 40 providing a phase reversal so the two radiators 60, 70 can efficiency radiate together. It is noted that if the two radiators 60, 70 were out of phase instead of in phase, that they would radiate at about a 35° upward incline from the horizontal and at a downward incline of about 35° from the horizontal. Such radiation would not be picked up by distant antennas on the Earth, which would not efficiently receive radio signals. By having a phase reversal at the lower end 54 of PDA 40, applicant can place the two radiators 60, 70, that both radiate at 1920 MHz, close together and each will radiate efficiency.

It should be noted that the length of a radiator which is important is its electrical length rather than its physical length. The electrical and physical lengths are usually about the same, but can differ due to the addition of impedance. For example, the coil 80 adds inductive impedance while the sleeve 44 (FIG. 5) of the PRD adds capacitive impedance which changes the electrical length of the radiators. The electrical length can be determined by the wavelength (or frequency) at which the radiator is resonant.

Care must be taken that the radiation from a lower conductor and from a higher conductor are in phase to add to one another (so the radiation propagates towards the horizon) rather than interfere (which causes the radiation to propagate at upward and downward inclines rather than toward the horizon). The present antenna includes PRD's (phase reversal devices) to assure that the radiations are in phase.

FIG. 4 shows that the lower conductor portion 34 includes a coil 80, a lower PRD 82 and a vertical wire length 84 extending between them. The distance G between the ground plane 14, and the lower end 92 of the coil is electrically approximately a ¼ wavelength radiator 90 for the 850 MHz band. The coil 80 does not radiate significantly, but has a length that provides a 180° phase shift, or phase reversal, at the 850 MHz frequency band. This results in currents in the lower radiator 90 of length G being in phase with those in the upper radiator 32 of length A formed by the upper conductor portion. The lower PRD 82 provides a phase reversal for the 1920 MHz frequency band, but has no effect on currents of 850 MHz. The lower PRD 82 has a sleeve 85 with a lower end 86 that is shorted to the central, or antenna conductor, while the sleeve upper end 93 is electrically isolated from the central conductor. The upper end 93 forms a phase reversal point for 1920 MHz. The length J, which includes the length of the PRD 82, is an electrical ⅜ wavelength at 1920 MHz and radiates energy at the 1920 MHz band, with the radiation being in phase with radiators 60 and 70 which are shown in FIG. 3.

FIG. 2 shows the electrical length of each radiating section of each of the two frequencies 850 MHz and 1920 MHz.

Applicant notes that the lower and upper PRDs 82, 40 that are each of an electrical length of ¼ wavelength at 1920 MHz, are not close to resonance at the 850 MHz band. As a result, currents of about 850 MHz pass through the PRDs as though the outer sleeve 44 were not present.

The length of about 12 to 14 inches of the antenna whip 10 of FIG. 2 above the ground plane 14 provides efficient radiators for two selected frequencies, including radiators at 32 and 90 of the heights A (FIG. 3) and G (FIG. 4) for the lower frequency, which is about 850 MHz. This is accomplished by providing two lower frequency radiators with a phase reversal coil 80 between them. One of the lower frequency radiators 90 is a ¼ wavelength radiator at the 850 MHz band, which has an input impedance of about 50 ohms so current can be efficiently fed into it, and the other 32 is a ½ wavelength radiator at the 850 MHz band. Applicant also provides radiators for a higher frequency, which is the 1920 MHz frequency band, along the radiators 81, 60 and 70. The lowest radiator 81 has an electrical length that is three-eighths wavelength at 1920 MHz. The actual physical length J (FIG. 4) is about ½ wavelength, but the electrical wavelength is shortened by impedance. The two higher 1920 MHz radiators 60, 70 are provided by positioning a PRD 40 between them to divide the long length A of the lower frequency radiator into two higher frequency radiators, each of them having an electrical length of about one-half wavelength at 1920 MHz.

Figure 6:
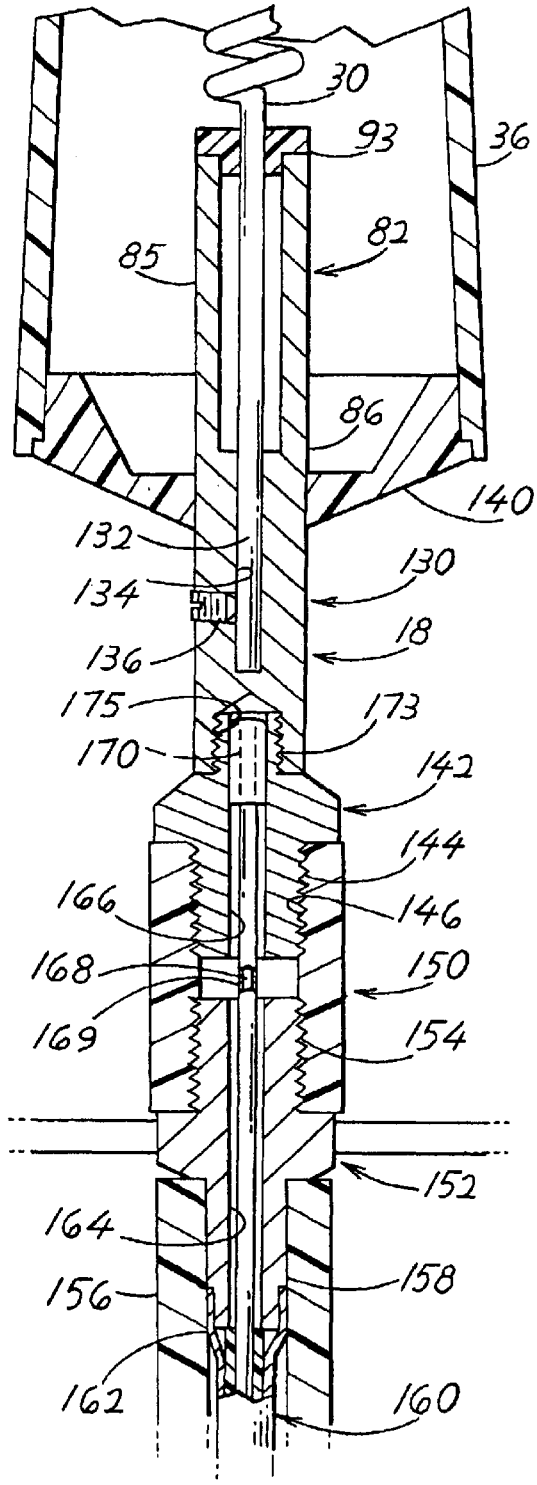
FIG. 6 is a sectional view of a lower part of the antenna of FIGS. 1-5, showing how it is mounted and connected to a coaxial feed.

FIG. 6 shows that the sleeve 85 of the lower PRD 82 is part of a robust machined mount member 130 that holds the antenna upright. The conductor 30 has a lower end 132 that projects into a hole 134 in the mount member, and that is held in place by setscrews 136. A lower cap 140 of the insulative mount shell 36 is molded around the mount member.

A machined metal coupling 142 has a threaded upper end 173 that is threaded into a threaded socket 175 at the lower end of the mount member. A threaded lower end 144 of the coupling is threaded into the upper end of a passage 146 of an insulative sleeve 150. A grounded fitting 152 has an upper end 154 threaded into the lower end of the insulative sleeve passage. A strong fiberglass support tube 156 surrounds and supports a lower end 158 of the fitting.

A coaxial feed (cable or connector) 160 that feeds signals to the antenna and that carries signals from the antenna, has an outer conductor 162 connected to the fitting 152 as by crimping. The signal-carrying inner conductor 168 of the coaxial cable (which has an insulation 169) extends through a passage 164 of the fitting and into a hole 166 at the lower end of the coupling and is soldered at a bared end at 170 to the coupling. The whip 18 can be detached from the mounting portion by unscrewing the whip at its socket 175 from the coupling threaded upper end at 173.

Forces on the upper portion of the antenna are transmitted through the shell 36 and from the lower cap 140 of the shell to the mount member 130, and finally to the support tube 156. The mount member 130 not only serves as a PRD at 82, but transmits forces and provides a reliable enclosed electrical connection at 170 to the inner conductor of the coaxial feed.

Figure 7:
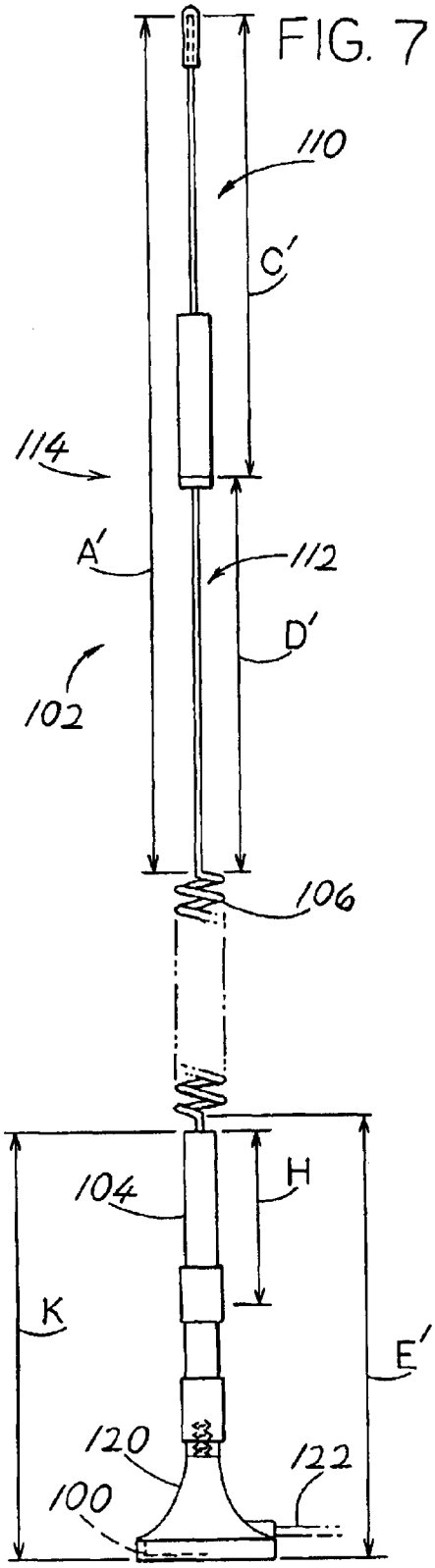
FIG. 7 is a front elevation view of an antenna of another embodiment of the invention.

FIG. 7 illustrates another arrangement that is more suitable for mounting on an automobile, where a magnet 100 at the lower end can hold to the steel frame of an automobile so that a hole does not have to be cut. The antenna 102 (FIG. 7) includes a lower PRD 104 of length H which is about an electrical ¼ wavelength at 1920 MHz, and includes a coil 106 that produces a 180° phase shift at 850 MHz. The antenna includes two high frequency (1920 MHz) radiators 110, 112 of lengths C' and D' which are the same as C and D in FIG. 3, and the antenna has an upper conductor portion 114 of length A' which is the same length A. These radiators 110, 112, 114 serve the same functions as the radiators 60, 70 and 32, respectively in FIG. 1. The coil 106 provides the same phase reversal as the coil 80 of FIG. 2. The PRD 104 provides the same phase reversal at the high frequency, and the lower portion forms a radiator of length E' which is an additional low frequency radiator of ¼ wavelength. The antenna forms a lower radiator for the higher frequency (1920 MHz) of length K. A cable 122 extends from the lower end of a base 120 that contains the magnet.

Thus, the invention provides an antenna which is of moderate height, which efficiently radiates at two frequencies that are not harmonic to one another, and specifically which efficiently radiates at both the 850 MHz band and the 1920 MHz band. The antenna has an upper conductor portion of a height that is about ½ wavelength (electrical) at 850 MHz to efficiently radiate at that frequency. The antenna has a lower portion of a height of one-quarter wavelength (electrical) at 850 MHz, and has a phase reversal in the form of a coil that lies between the lower and upper conductor portions that radiate at 850 MHz so the radiating fields do not interfere. The antenna has three conductor portions that radiate at 1920 MHz, with phase reversal means between them, and with the lowest having a length of three-eighths wavelength (electrical) at 1920 MHz. The lowermost conductor for 850 MHZ lies below a coil that produces a phase reversal at 850 MHz. The ¼ wavelength (at 850 MHz) radiator lies between the bottom of the coil and a ground plane. A lower PRD and conductor, both lying below the coil, produces the lowermost radiator for 1920 MHz. The lower PRD includes a machined metal mount member whose upper end forms the conductive sleeve of the PRD, whose lower end serves to connect to the inner conductor of a coaxial feed, and which supports an insulative shell.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An antenna that is capable of radiating at a short wavelength and that is capable of radiating at a long wavelength that is longer than said short wavelength, comprising:

an antenna whip with upper and lower conductor portions, said upper conductor portion having an electrical length of about ½ wavelength of said long wavelength to effectively radiate at said long wavelength;

an upper phase reversal device that reverses the phase of currents of said higher frequency without trapping currents of said higher frequency and without affecting currents of said lower frequency, said upper phase reversal device having a phase reversal point and being located along said upper conductor portion;

said upper conductor portion having radiator portions for said short wavelength that include top and bottom conductor parts, said bottom conductor part extends below said phase reversal point of said phase reversal device and has an electrical length of about ½ wavelength of said short wavelength, to create a first short wavelength radiator;

said top conductor part extends above said phase reversal point of said phase reversal device, and the length of said top conductor part plus the length of said phase reversal device is an electrical ½ wavelength of said short wavelength, to create a second short wavelength radiator;

said upper phase reversal device includes an inner conductor and a sleeve-shaped outer conductor that extends around and is spaced from said inner conductor, said sleeve having first and second ends, said sleeve being in electrical contact with said inner conductor only at said first end, and said sleeve second end being isolated from direct contact with said inner conductor and forming said phase reversal point, said phase reversal device being nonresonant to said long wavelength, but said phase reversal device being resonant at said short wavelength to create a 180° phase shift, to thereby maintain currents in said first and second short wavelengths radiators in phase.

2. The antenna described in claim 1 wherein:

said short wavelength is the wavelength of a frequency band of 1850 to 1990 MHz and said long wavelength is the wavelength of a frequency band of 806 to 894 MHz;

said upper conductor portion is resonant at ½ wavelength at about 850 MHz and has a length of 6.9 inches plus or minus 8%;

of said top and bottom conductor parts at least one is resonant at ½ wavelength at about 1920 MHz and has a length of 3.3 inches plus or minus 8%.

3. The antenna described in claim 1 wherein:

said lower conductor portion includes a coil which creates a phase reversal at said long wavelength, said coil tying between said upper and lower conductor portions; and including a lower phase reversal device which reverses phase at said short wavelength, said lower phase reversal device lying along said lower conductor portion and below said coil, said lower phase reversal device including a sleeve surrounding said lower conductor and having a length of about ¼ wavelength at said short wavelength, said sleeve having a shorted lower end and a non-shorted upper end lying below said coil.

4. An antenna capable of radiating at a short wavelength and capable of radiating at a long wavelength that is longer than said short wavelength, comprising:

an antenna whip with upper and lower conductor portions, said upper conductor portion forming a radiator capable of radiating at both said long wavelength and said short wavelength to form an upper longwave radiator and an upper shortwave radiator;

said lower conductor portion includes a coil constructed to produce a 180° phase shift at said longer wavelength, said lower conductor portion also including a lower phase reversal device which produces 180° phase shift at said shorter wavelength but which does not produce a phase shift at said longer wavelength, said phase reversal device lying below said coil;

said lower phase reversal device having a predetermined length and having a phase reversal point at its upper end, and the distance between said phase reversal point and a lower end of said coil being less than the length of said phase reversal device.

5. The antenna described in claim 4 wherein:

said lower phase reversal device comprises a central conductor and an electrically conductive sleeve surrounding said central conductor with a space between them, said sleeve having an upper end at the upper end of said phase reversal device, said phase reversal device having a predetermined length, and said sleeve is connected to said central conductor only at a lower end of said lower phase reversal device.

6. The antenna described in claim 5 including:

an insulative mount shell surrounding said coil and said lower phase reversal device, said shell having an upper end physically connected to said upper conductor adjacent to a junction between an upper end of said coil and a lower end of said upper conductor portion, and said shell having a lower end connected to said lower conductor portion at about the lower end of said phase reversal device.

7. The antenna described in claim 5 including:

a machined metal mount member having a vertical axis and an upper portion forming said conductive sleeve, said mount member having a bore extending along its axis below said upper portion that forms said sleeve, and said central conductor extends downward into said bore and is connected thereat to said mount member.

8. The antenna described in claim 4 wherein:

said lower phase reversal device has a length equal to a ¼ wavelength of said short wavelength.

9. The antenna described in claim 4 wherein:

said upper conductor portion has upper and lower ends and includes a phase reversal device comprising a vertical conductive sleeve having upper and lower sleeve ends and a vertical wire portion extending through said sleeve and connected to said sleeve only at its upper end, the distance between said sleeve ends being ¼ wavelength of said shorter wavelength.

10. The antenna described in claim 4 wherein:

said short wavelength is 850 MHz and said long wavelength is 1920 MHz.

11. An antenna which transmits at a given short wavelength comprising:

an antenna whip with a conductor having an upper portion forming two radiators that each radiates at said short wavelength, said conductor upper portion including a PRD (phase reversal device) with a shorted PRD end, and with an opposite open, or non-shorted end;

said PRD includes a center conductor portion of said upper conductor and a conductive sleeve that surrounds said center conductor portion, said sleeve having opposite ends with an upper one of said sleeve ends directly engaged with said PRD conductor portion to form said shorted PRD end, and with a lower one of said sleeve ends being non-shorted to said conductor portion, the length of said sleeve being ¼ wavelength of said short wavelength to produce a 180° phase shift to keep said two radiators in phase.

12. The antenna described in claim 11 wherein said antenna is designed to also transmit at a long wavelength, said long wavelength being the wavelength at 850 MHz and said short wavelength being the wavelength at 1920 MHz, wherein:

said conductor upper portion has a length equal to a half wavelength at 850 MHz, the distance between an upper end of said conductor upper portion and said non-shorted end of said PRD is a half wavelength at 1920 MHz.

13. The antenna described in claim 11 wherein said antenna is designed to radiate at a long wavelength that is at least 150% of said short wavelength; wherein:

said antenna includes a conductor lower portion with a lower end forming a ground plane connection, and a coil that is resonant to said long wavelength and that has a coil upper end lying at a lower end of said conductor upper portion and a coil lower end spaced from said lower end of said conductor lower portion;

the length of said upper conductor portion being equal to a half wavelength at said long wavelength, and the distance between said ground plane connection and said coil lower end being equal to ¼ wavelength of said long wavelength.

14. In an antenna that is capable of radiating at a short wavelength and that is capable of radiating at a long wavelength that is longer than said short wavelength and that is nonresonant to said short wave, wherein said antenna includes an antenna conductor with a first portion that forms a radiator at said long wavelength and that forms two short radiators at said short wavelength that extend in opposite directions from a point that lies between said two short radiators, the improvement comprising:

a phase reversal device that includes a conductive sleeve having a length of about one-quarter wave at said short wavelength and surrounding said antenna conductor with a space between them, said sleeve having a shorted end where said sleeve is connected to said antenna conductor, said sleeve having an opposite non-shorted end and said sleeve being free of connection to said antenna conductor except at said shorted end;

said non-shorted end of said sleeve lying at said point that lies between said two short radiators.

15. The antenna described in claim 14 wherein:

said long wavelength is the wavelength at 850 MHz and said short wavelength is the wavelength at 1920 MHz.

16. An antenna that is capable of radiating at a short wavelength and that is capable of radiating at a long wavelength that is longer than and nonresonant to said short wavelength, comprising:

an antenna whip which includes an antenna conductor having upper and lower portions;

a phase reversal device lying along said whip and comprising a conductive sleeve that surrounds said antenna conductor lower portion, said sleeve having a lower end that is shorted to said antenna conductor;

a machined metal mount member that has an axis and an upper portion forming said conductive sleeve of said phase reversal device, said mount member having a hole lying on said axis and extending below said sleeve, with said antenna conductor projecting into said hole and fixed in place thereat.

17. The antenna described in claim 16 including:

a sleeve-shaped insulator, said mount member having a lower end that projects down into an upper part of said sleeve-shaped insulator, said mount member lower end having a bore;

a conductive fining that has an upper end that projects upwardly into said sleeve-shaped insulator, and that has a lower end, said fitting having a vertical through hole;

a coaxial feed that has an inner conductor that extends upwardly through said vertical through hole in said fitting and into said vertical bore in said mount member and that is electrically connected to said mount member.

* * * * *